US006655762B2

(12) United States Patent
Krueger

(10) Patent No.: US 6,655,762 B2
(45) Date of Patent: Dec. 2, 2003

(54) DRAWER WITH INTERCHANGEABLE LOCK ASSEMBLY

(75) Inventor: Todd D. Krueger, Lillington, NC (US)

(73) Assignee: Bob Barker Company, Inc., Fuquay-Varina, NC (US)

( * ) Notice: Subject to any disclaimer, the term of this patent is extended or adjusted under 35 U.S.C. 154(b) by 49 days.

(21) Appl. No.: 09/770,787

(22) Filed: Jan. 26, 2001

(65) Prior Publication Data

US 2002/0101142 A1 Aug. 1, 2002

(51) Int. Cl.[7] ..... A47B 88/00
(52) U.S. Cl. ..... 312/333; 312/330.1; 70/85
(58) Field of Search ..... 312/330.1, 332.1, 312/333, 348.4, 348.6; 70/85, 86, 87, 88

(56) References Cited

U.S. PATENT DOCUMENTS 4,030,788 A * 6/1977 Bleeker ..... 312/333
4,379,603 A * 4/1983 Johnson et al. ..... 312/348.6
4,639,052 A * 1/1987 Posso ..... 312/333
4,873,850 A * 10/1989 Lyons et al. ..... 312/333 X
5,074,009 A * 12/1991 Simonton et al. .... 312/348.6 X
5,292,191 A * 3/1994 Slivon ..... 312/332.1
5,606,880 A * 3/1997 Viggiano ..... 70/86
5,868,478 A * 2/1999 Yemini ..... 312/332.1
6,412,317 B1 * 7/2002 Martin ..... 70/86 X

FOREIGN PATENT DOCUMENTS

CA 568243 * 12/1958 ..... 312/332.1

* cited by examiner

*Primary Examiner*—James O. Hansen
(74) *Attorney, Agent, or Firm*—Coats & Bennett, P.L.L.C.

(57) ABSTRACT

A drawer assembly with an interchangeable lock for mounting on a furniture piece. The drawer assembly comprises a storage area formed by exterior walls. In one embodiment, a front wall includes a cut-out section in which an adapter plate is removably mounted. A locking bar having first and second ends is selectively positioned adjacent to the adapter plate to mate with different locks. The first end includes a tongue that extends through the adapter plate to receive a hasp lock. The second end includes an angled edge for mating with an integrated lock mounted within the adapter plate.

21 Claims, 7 Drawing Sheets

DRAWER WITH INTERCHANGEABLE LOCK ASSEMBLY

BACKGROUND OF THE INVENTION

The present invention is directed to a drawer mounted within a furniture piece and, more particularly, to a drawer configured to mount a variety of interchangeable locking assemblies for use in maintaining the drawer in a locked position.

It is often advantageous to mount drawers on existing furniture to provide the user with additional storage space and security. Preferably, the installation and addition of drawers can be formed in a straightforward method that is not too costly or time consuming during the installation. The drawers should be sturdy and include a locking assembly such that the user can confidently place valuable items within the drawer with the knowledge that they are safe.

Additionally, the ability to change locking assemblies is advantageous for a user. Many drawers are equipped with a permanent locking mechanism integrally mounted within the drawer structure. The ability to use different locks in different situations is not an option for these types of drawers as changing the lock assemblies requires that the entire drawer be replaced. The ability for the drawer to accommodate varying types of locking assemblies is advantageous as particular users may prefer different types of locking assemblies when using the drawer in different situations.

Many drawers cannot be unlocked without completely disassembling the drawer assembly when the key or combination is missing. This may lead to problems in the event the user either forgets the combination or key, or when it is necessary for a second party to get into the drawer when the user is not available. For example, if the user becomes sick and needs medicine kept inside the drawer, the second party cannot access the medicine without either destroying or disassembling the drawer.

Institutional facilities, such as prisons, often use this type of drawer and locking assembly for their inmates. Special requirements are necessary for institutional use, such as the drawers should not be able to be removed from the furniture piece or any of the individual parts removed from the drawer assembly because inmates may use these to facilitate escape or to injure others. It is further important that the drawers provide secure storage for the inmates to prevent others from accessing the private and valuable items they have stored therein. It is further advantageous that the locks can be removed without destroying the entire drawer or disassembling the entire drawer in the event that prison officials need to access the interior of the drawer looking for contraband or miscellaneous other items.

Therefore, there is a need for a drawer having an interchangeable locking assembly which provides secure storage of items.

BRIEF SUMMARY OF THE INVENTION

The present invention is directed to a drawer having multiple locks that are interchangeable depending upon the needs of the user. Adapter plates are removably mounted to the drawer and include at least a first adapter plate adapted to receive a first lock type, and a second adapter plate adapted to receive a second lock type. In one embodiment, the adapter plate includes an aperture for receiving a locking bar and a lock. In another embodiment, the adapter plate includes an integrated lock.

A locking bar may be adapted to be positioned adjacent to adapter plate when the drawer is in the closed position. The locking bar comprises a first end for mating with a first adapter plate and a second end for mating with a second adapter plate. The locking bar is movably aligned such that the corresponding end can be aligned with the adapter plate mounted to the drawer. In one embodiment in which the adapter plate includes an integrated lock, the locking bar comprises a contact edge having a wedge extending outward therefrom. The integrated lock includes a plunger movable between a locked position in which the plunger is in an extended orientation and an open position in which the plunger is in a retracted orientation. The plunger includes a groove that abuts against the wedge in the locked position to prevent the drawer from being opened when the plunger is the locked orientation.

The invention further includes the method of locking a drawer comprising providing at least two adapter plates with a first adapter plate having a first lock type and a second adapter plate having a second lock type. One of the adapter plates is selected and installed on the drawer. Sometime thereafter, the adapter plate is removed and a second adapter plate is installed.

DETAILED DESCRIPTION OF THE INVENTION

Figure 1:
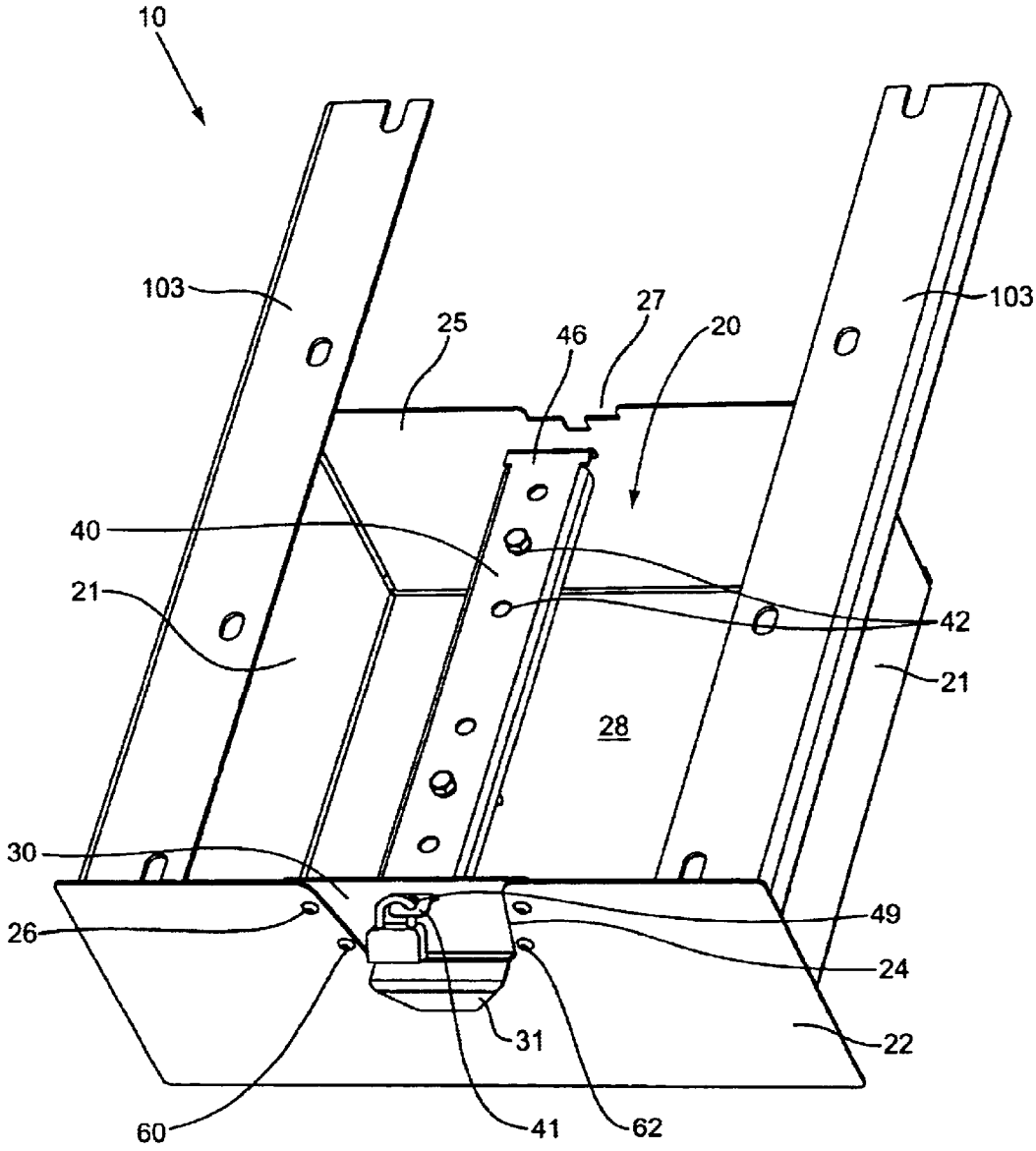
FIG. 1 is a top perspective view illustrating one embodiment of the drawer assembly constructed in accordance with the present invention.

The present invention is directed to a drawer assembly with an interchangeable lock. As illustrated in FIG. 1, the drawer assembly, generally illustrated as 10, includes storage area 20 formed by exterior walls. A front wall 22 includes a cut-out section 24 in which an adapter plate 30 is removably mounted. A locking bar 40 having first and second ends 48, 46 (FIG. 2) is selectively positioned to mate with different locks. The first end 48 may be positioned forward and includes a tongue 41 that extends through the adapter plate 30 to receive a hasp lock (not illustrated). The second end 46 includes a contact edge 45 for mating with an integrated lock 32 (FIG. 4B) mounted within an alternate adapter plate 30.

Figure 2:
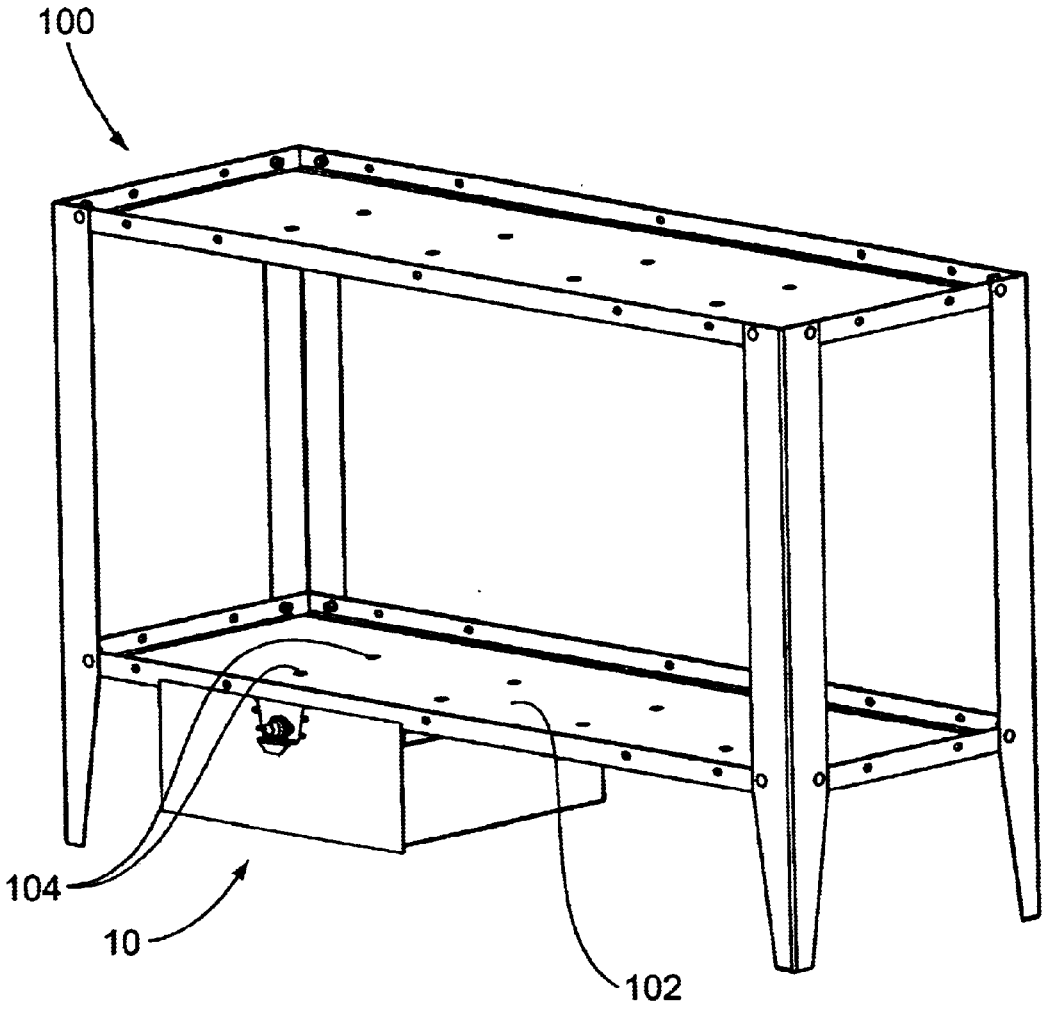
FIG. 2 is a top perspective view illustrating one embodiment of the drawer assembly mounted to a furniture piece.

FIG. 2 illustrates one application of the drawer assembly 10 being mounted to a furniture piece 100. Drawer assembly 10 is movably positioned between an open position in which the user has access to the interior of the storage area 20 and a closed position as illustrated in FIG. 2 in which the interior is not accessible and the drawer assembly 10 may be locked to prevent access. A mounting platform 102 forms the top wall of the storage area 20 and may include apertures 104 to receive fasteners for attaching the drawer assembly 10 to the furniture piece 100. Alternatively, drawer assembly 10 may be welded, bonded, or otherwise attached to the furniture piece 100 in a variety of manners well understood and appreciated in the art. The term furniture piece 100 is understood herein to mean household and institutional furniture including beds, desks, chairs, and other like pieces to which the drawer assembly 10 may be mounted.

Figure 3:
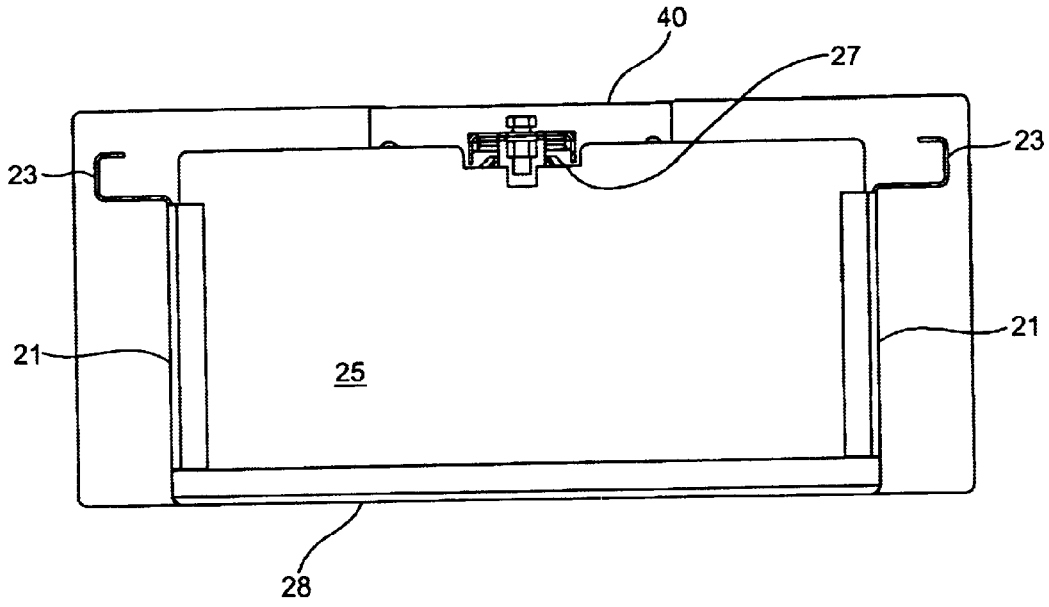
FIG. 3 is a rear elevational view of the drawer assembly of one embodiment of the drawer assembly.

Storage area 20 as illustrated in FIG. 1 is formed by front 22, back 25, side 21, and bottom 28 walls and may have a variety of shapes and sizes depending upon the size of the furniture piece 100 and the needs of the user. The walls abut together forming a continuous shell that prevents items from escaping from the interior and generally preventing dirt or other debris from entering the interior. Front wall 22 includes a cut-out section 24 for mounting the adapter plate 30 and may have a variety of sizes and dimensions. In one embodiment, cut-out section 24 is an aperture positioned within one of the walls of the drawer assembly 10. As illustrated in FIG. 1, cut-out section 24 is positioned at an upper, central area of the front wall 22. Apertures 26 may further be positioned about the edges of the cut-out section 24 for receiving fasteners 60 when the adapter plate 30 is attached to the front wall 22. As illustrated in FIG. 3, arms 23 may extend outward from the side walls 21 for mounting on guide rails 103 (FIG. 1) positioned on the furniture piece 100 for sliding the drawer assembly 10 between open and closed positions. A cut-away section 27 conforms to the dimensions of the locking bar 40 to allow the back wall 25 to slide past the locking bar 40 when moving between open and closed positions.

Figure 4A:
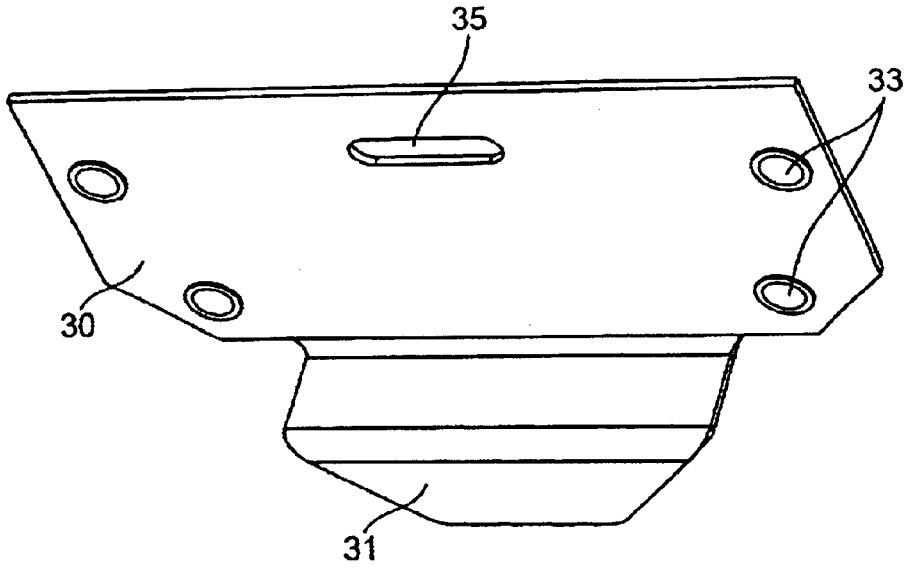
FIG. 4A is a perspective view of an adapter plate for receiving a hasp lock.
Figure 4B:
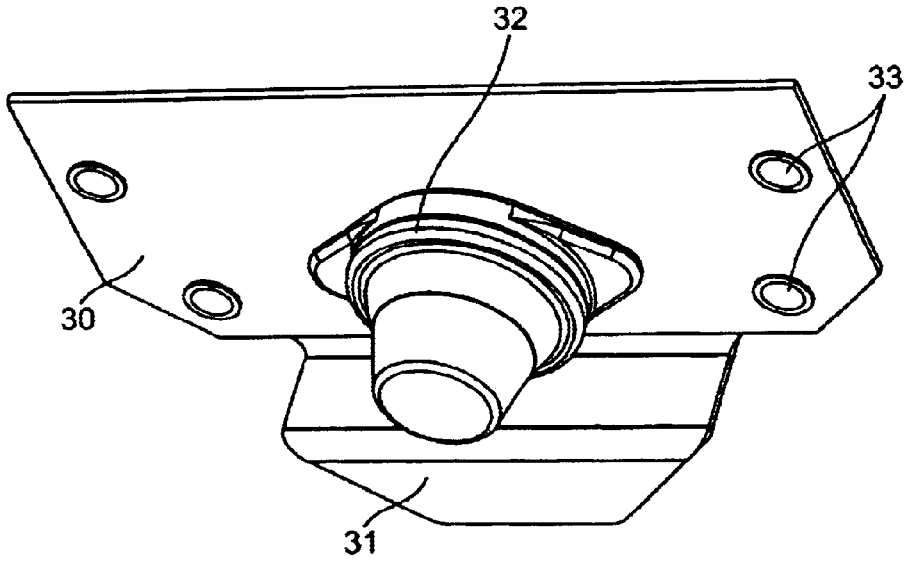
FIG. 4B is a perspective view of an adapter plate having an integrated lock.

A variety of adapter plates 30 may be positioned within the cut-out section 24. Two embodiments are illustrated in FIGS. 4A and 4B and may include a handle 31 extending outward for grasping by the user, and apertures 33 to receive fasteners 60 for mounting to the front wall 22. In one embodiment, adapter plate 30 is mounted on an inside surface of the front wall 22 as illustrated in FIG. 1. Apertures 33 align with apertures 26 on the front wall 22 to receive fasteners 60 for removably mounting the adapter plate 30. In one embodiment illustrated in FIG. 1, fasteners 60 are mounted with a head section 62 extending outward and a tail end that receives a nut (not illustrated) positioned on the inner edge. Head section 62 is adapted to receive a tool for removing the fastener 60. When an integrated lock 32 is mounted to the front wall 22, fasteners 60 can be removed when the drawer assembly 10 is in the closed and locked position in the event that the user loses the key or combination, or refuses to open the lock. In one embodiment, fastener 60 is a Blind Threaded Captive Fastener constructed by AVK Industrial Products.

Figure 4C:
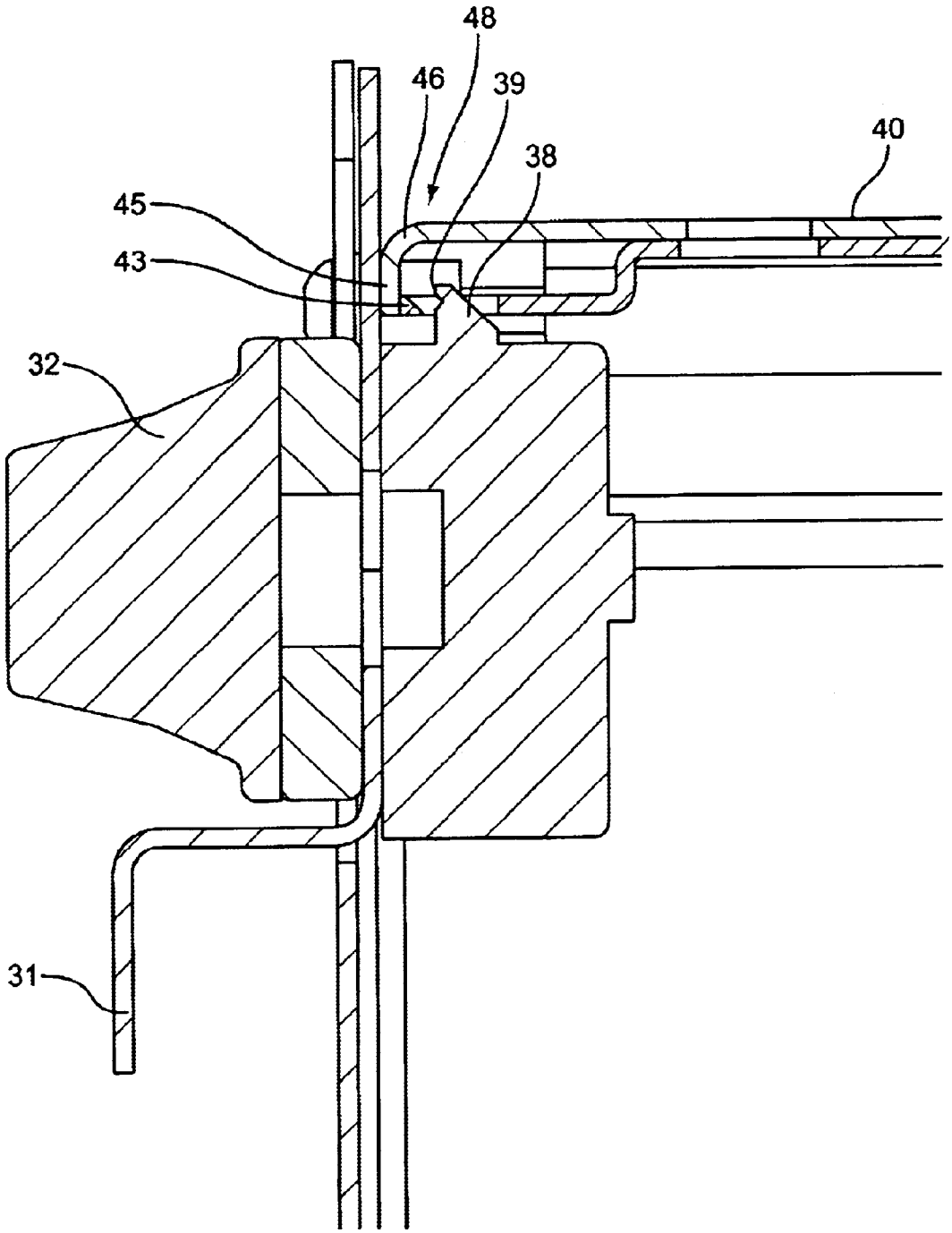
FIG. 4C is a side view of the integrated lock of FIG. 4B mounted to the front wall of the drawer assembly and positioned adjacent to the locking bar.

FIG. 4A illustrates an adapter plate 30 for use in receiving a hasp lock (not illustrated). An opening 35 is sized to receive a tongue portion 41 of the locking bar 40 as illustrated in FIG. 1. A lock may then be mounted to the tongue portion 41 to lock the drawer assembly 10 in the closed position. FIG. 4B illustrates an integrated lock 32 mounted therein. Integrated lock 32 may be operated via a tumbler for inputting a combination, a key hole for receiving a key, or other. Integrated lock 32 includes a plunger 38 for mounting against the locking bar 40 as illustrated in FIG. 4C. Plunger 38 is statically positioned in an upright position when locked and abuts against contact edge 45 to prevent the drawer assembly 10 from being opened. When the user opens the integrated lock 32, plunger 38 retracts below the lock end 46. In one embodiment, integrated lock 36 is selected from one of the following: Serial No. 1654, Serial No. 1630, Serial No. 1631, Serial No. 1655, Serial No. 1670, and Serial No. 1671, each manufactured by the Master Lock Company of Milwaukee, Wis. Plunger 38 further includes a groove 39 for mounting against the locking bar end 46.

Figure 5:
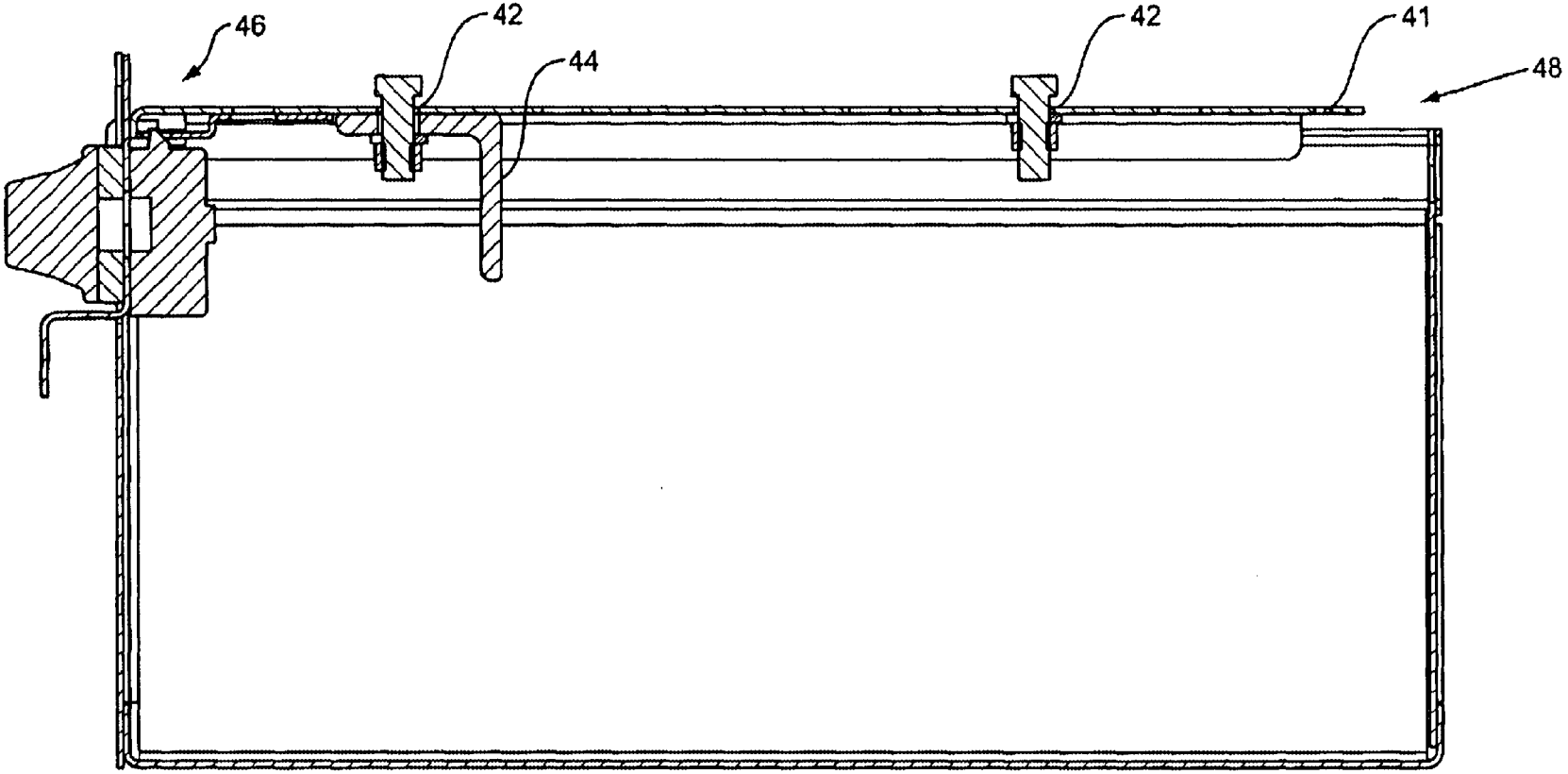
FIG. 5 is a side view illustrating the locking bar and integrated lock mounted to the storage area.
Figure 6:
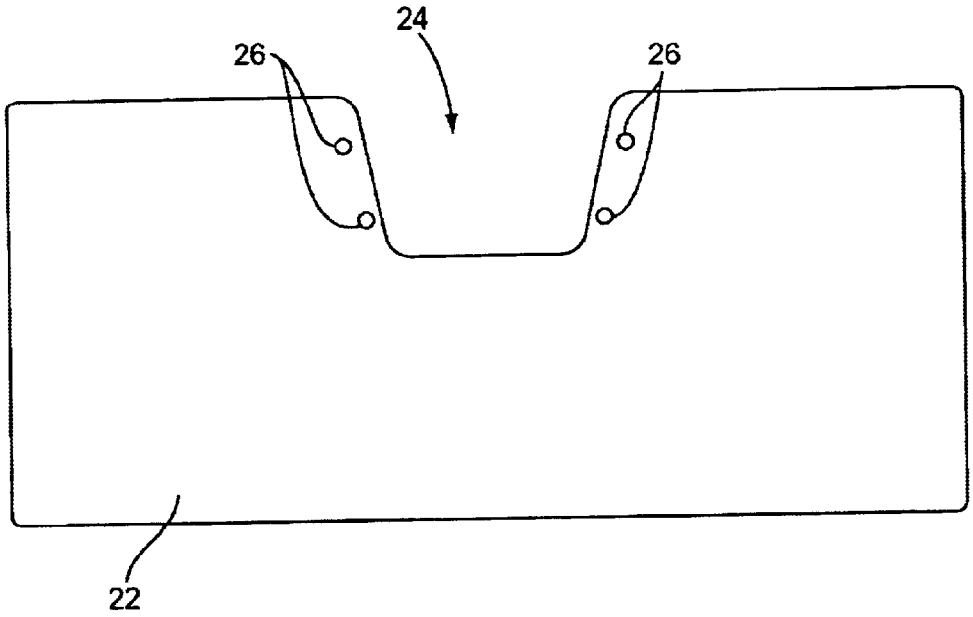
FIG. 6 illustrates a front view of one embodiment of the front wall 22 of the drawer having a cut-out section 24.
Figure 7:
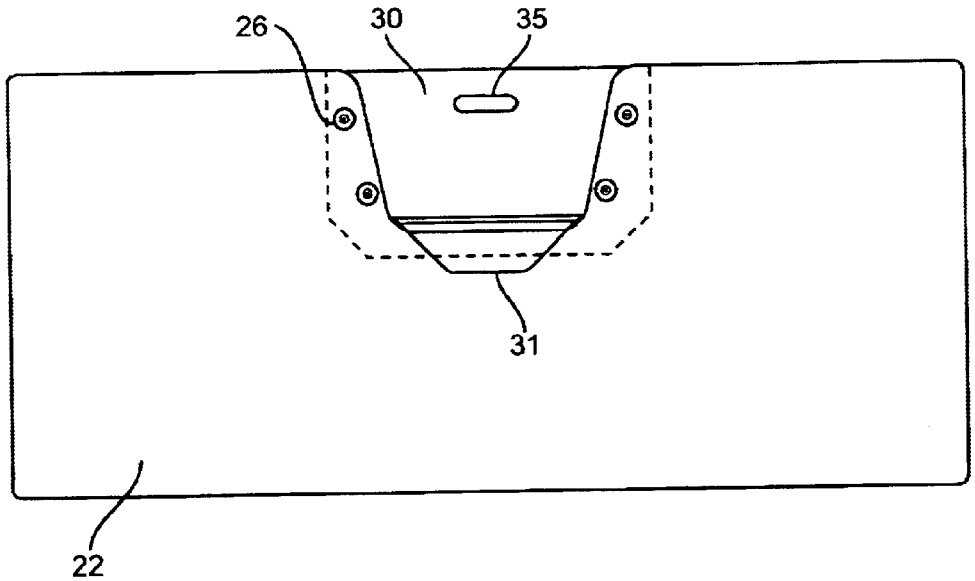
FIG. 7 illustrates one of the pair of adapter plates 30 interchangeably positioned behind the cut-out section 24 of the front wall 22 of the drawer. The edges of the cut-out section are at least partially exposed when either the first adapter plate or the second adapter plate is mounted on the drawer. The portion of the edges that are not exposed are covered by the handle 31.

Locking bar 40 is mounted to the furniture piece 100 and works in conjunction with the adapter plate 30 to lock the drawer assembly 10 in the closed position. As illustrated in FIG. 5, locking bar 40 includes apertures 42 that align with furniture piece apertures 104 to mount to the mounting plate 102. A stop 44 connected to the locking bar 40 extends into the interior of the storage area 20 and contacts the back wall 25 to limit the drawer assembly 10 range of motion in the open position. Stop 44 further prevents the drawer from being removed from the furniture piece, which may be required for institutional use. A first hasp end 48 includes a tongue 41 sized to extend through the adapter plate opening 35. Tongue 41 includes an aperture 49 through which a lock is attached to lock the drawer assembly 10 in the closed position. A second integrated lock end 46 is positioned opposite the hasp end 48. Lock end 46 includes a contact edge 45 that extends downward and contacts the plunger 38 of the integrated lock 32. Contact edge 45 may be shaped in a variety of angles. In the embodiment illustrated in FIG. 4C, a wedge 43 extends from the edge 45 and conforms to the dimensions of the plunger groove 39. When the drawer assembly 10 is attempted to be pulled to the open position when locked, wedge 43 seats within the groove 39 preventing the user from vibrating or otherwise moving the plunger 39 beyond the angled edge 45. The embodiments illustrated indicate wedge 43 having an angled edge that mates within groove 39, however one skilled in the art will understand that wedge 43 may have a variety of embodiments allowing it to contact and catch within groove 39. In one embodiment, wedge 43 has a blunt front that is sized to contact and catch within groove 39 when the drawer is pulled open. Groove 39 may also have a variety of orientations that correspond to the wedge 43 such as an angled format as illustrated in FIG. 4C, square shape, oval, etc. In one embodiment, groove 39 is about 0.02 inches deep.

In use, the guides 102 are mounted on the furniture piece 100 and the locking bar 40 is mounted with the desired end facing outward to be adjacent to the corresponding adapter plate 30. In one embodiment, the hasp adapter plate 30 is mounted within the cut-out section 24. The locking bar 40 is mounted such that the first end extends outward a distance for the tongue portion 41 to fit within the aperture 35 when the drawer is in the closed position. The user may then apply a lock to the tongue portion aperture 49 to lock the drawer assembly 10 in the closed position.

Converting the drawer assembly 10 includes adjusting the locking bar 40 such that the second end having the contact edge 45 faces the front wall 22. The adapter plate 30 is exchanged with one having an integrated lock 32. The drawer assembly 10 may be locked by positioning it in the closed position such that the plunger 38 is behind the contact edge 45 and wedge 43. The drawer assembly 10 is opened by opening the integrated lock 32 either by combination or key such that the plunger 38 retracts below the contact edge 45 allowing the drawer assembly 10 to be slid open. The drawer assembly 10 may also be used with no adapter plate 30. The opening in the front wall 22 where the adapter plate 30 is normally mounted remains open providing a surface for the user to grasp when opening and closing the drawer.

In the embodiments illustrated, the adapter plate 30 is mounted within an upper central portion of the front wall 22 and the locking bar 40 is positioned to make contact with the adapter plate 30. However, the adapter plate 30 may be positioned at other locations within the drawer assembly 10 such as on the bottom wall 28 and the side walls 21. Within these embodiments, the locking bar 40 would be positioned to correspond to the adapter plate 30.

The present invention may be carried out in other specific ways than those herein set forth without departing from the scope and essential characteristics of the invention. One skilled in the art that a variety of different locking mechanisms may be used in either embodiment for locking the drawer assembly 10 in the closed position. The present embodiments are, therefore, to be considered in all respects as illustrative and not restrictive, and all changes coming within the meaning and equivalency range of the appended claims are intended to be embraced therein.

What is claimed is:

1. A storage member mounted within a furniture piece comprising:

a. a drawer movably positioned within the furniture piece between open and closed positions, the drawer having an interior space formed by bottom, front, back, and side walls, the front wall having a cut-out section with edges, the cut-out section located in an upper section of the front wall;

b. a pair of adapter plates interchangeably positioned behind the cut-out section, a first adapter plate of said pair adapted to receive a first lock type, and a second adapter plate of said pair adapted to receive a second lock type, the edges being at least partially exposed when either the first adapter plate or the second adapter plate is mounted on the drawer; and c. a locking bar extending outward from the furniture piece and having a first end that mates within an aperture in the first adapter plate in the closed position.

2. The device of claim 1, wherein the adapter plates are positioned on an inner surface of the front wall.

3. The device of claim 2, further comprising apertures within the adapter plates and the front wall to receive fasteners for removably mounting the adapter plates to the front wall.

4. The device of claim 1, wherein the second adapter plate comprises an integrated lock to lock the drawer in the closed position.

5. The device of claim 4, wherein the locking bar mates with the integrated lock to lock the drawer in the closed position.

6. The device of claim 1, wherein at least one edge of the adapter plates overlap the front wall when the adapter plate is mounted within the cut-out section.

7. The device of claim 1, wherein each pair of adapter plates comprises a handle that extends over the front wall of the cut-out section and covers a section of the edges of the cut-out section.

8. A storage member mounted within a furniture piece comprising:

a. a drawer movably positioned within the furniture piece between open and closed positions, the drawing having an interior space formed by bottom, front, back, and side walls;

b. a locking bar adapted to be attached to the furniture piece and positioned adjacent to the front wall when the drawer is in the closed position; and c. a pair of adapter plates interchangeably positioned on the front wall, a first adapter plate of said pair having an aperture through which the locking bar extends when the drawer is in the closed position, and a second adapter plate of said pair comprising an integral lock having a plunger to contact the locking bar when the drawer is in the closed position to prevent the drawer from being moved to the open position.

9. The drawer of claim 8, wherein the adapter plates are positioned on an inner surface of the front wall.

10. The drawer of claim 8, wherein the adapter plates and the front wall comprise a plurality of apertures to receive fasteners and mount the adapter plate to the front wall, the fasteners being mounted with a head positioned on an outer surface of the front wall.

11. A storage member mounted within a furniture piece comprising:

a. a drawer having bottom, side, front and back walls forming a storage area therein;

b. a locking bar adapted to be adjustably mounted on the furniture piece adjacent to the drawer, the locking bar being having a first end for mating with a first lock-type, and a second end for mating with a second lock-type, the locking bar being adjustable between a first position in which the first end is adjacent to the front wall and a second position in which the second end is adjacent to the front wall; and c. an adapter plate mounted to the front wall to mount with the locking bar.

12. The device of claim 11, wherein one of the first and second ends comprises a tongue portion for extending through an aperture in the adapter plate.

13. The device of claim 11, wherein one of the first and second ends comprises a contact edge to mount adjacent to the adapter plate.

14. The device of claim 13, wherein the adapter plate comprises an integrated lock having a plunger that abuts against the contact edge to maintain the device in a closed position.

15. The device of claim 14, wherein the contact edge comprises a wedge that mates with a groove within the plunger.

16. The device of claim 11, wherein the locking bar is positioned within an open side of the drawer.

17. A storage member mounted within a furniture piece comprising:

a. a drawer defining a storage space to store items;

b. a locking bar adjustably mounted to the furniture piece between a first position in which a first end is positioned towards the drawer and a second position in which a second end is positioned towards the drawer, the second end comprising a contact edge having a wedge extending outward therefrom; and c. a locking assembly mounted to the drawer and positioned adjacent to the locking bar when the drawer is in a closed position, the locking assembly comprising a plunger movable between a locked position in which the plunger is in an extended orientation and an open position in which the plunger is in a retracted orientation, the plunger having a groove that abuts against the wedge in the locked position to prevent the drawer from being opened when the plunger is the locked position.

18. A method of locking a drawer that is mounted within a furniture piece, the method comprising the steps of:

a. providing at least a first adapter plate having a first lock type and a second adapter plate having a second lock type;

b. selecting the first adapter plate;

c. attaching the first adapter plate to the drawer;

d. securing the drawer in a closed position; and e. removing the first adapter plate from the drawer and attaching the second adapter plate to the drawer and securing the drawer in the closed position.

19. The method of claim 18, wherein the step of securing the drawer in the closed position using the first adapter plate comprises a positioning a locking bar through an aperture in the adapter plate.

20. The method of claim 18, wherein the step of securing the drawer in the closed position using the second adapter plate comprises attaching an integrated lock within the adapter plate to a locking bar.

21. The method of claim 18, further comprising the step of removing the second adapter plate from the drawer leaving an opening for a user to grasp when opening and closing the drawer.

* * * * *